US008994482B2

(12) United States Patent
Yokoyama et al.

(10) Patent No.: US 8,994,482 B2
(45) Date of Patent: Mar. 31, 2015

(54) ELECTROMAGNETIC CONTACTOR

(75) Inventors: Shoji Yokoyama, Hachioji (JP); Yuichi Yamamoto, Kounosu (JP)

(73) Assignees: Fuji Electric Co., Ltd., Kawasaki-shi, Kanagawa (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/878,366

(22) PCT Filed: May 9, 2012

(86) PCT No.: PCT/JP2012/003041
§ 371 (c)(1),
(2), (4) Date: May 20, 2013

(87) PCT Pub. No.: WO2012/157216
PCT Pub. Date: Nov. 22, 2012

(65) Prior Publication Data

US 2013/0229248 A1 Sep. 5, 2013

(30) Foreign Application Priority Data

May 19, 2011 (JP) ..... 2011-112911

(51) Int. Cl.
*H01H 9/30* (2006.01)
*H01H 9/36* (2006.01)
*H01H 50/02* (2006.01)
(Continued)

(52) U.S. Cl.
CPC ..... *H01H 9/362* (2013.01); *H01H 50/02* (2013.01); *H01H 9/346* (2013.01); *H01H 9/443* (2013.01); *H01H 51/065* (2013.01); *H01H 50/546* (2013.01); *H01H 2050/025* (2013.01)
USPC ..... 335/201; 335/131

(58) Field of Classification Search
USPC ..... 335/201
See application file for complete search history.

(56) References Cited

U.S. PATENT DOCUMENTS 6,768,405 B2 * 7/2004 Nishida et al. ..... 335/177
6,897,750 B2 * 5/2005 Neuberth ..... 335/296
(Continued)

FOREIGN PATENT DOCUMENTS

JP S57-194421 A 11/1982
JP H02-11704 Y2 3/1990
(Continued)

OTHER PUBLICATIONS

Japan Patent Office, "Document submission for JP2011-112911," Jul. 30, 2013.

*Primary Examiner* — Shawski S Ismail
*Assistant Examiner* — Lisa Homza
(74) *Attorney, Agent, or Firm* — Manabu Kanesaka

(57) ABSTRACT

An electromagnetic contactor has an arc extinguishing chamber housing a contact mechanism having a pair of fixed contacts and a movable contact that contacts with the pair of fixed contacts. The arc extinguishing chamber has a plate-shaped fixed contact support insulating substrate including through holes to fix at least the pair of fixed contacts and formed with a metal foil on an outer peripheral circumferential edge of one surface by a metalizing process. The pair of fixed contacts and a metal cylindrical body are brazed and joined to the metal foils of the fixed contact support insulating substrate, and an insulating cylindrical body is disposed on an inner peripheral surface of the metal cylindrical body.

1 Claim, 10 Drawing Sheets

(51) Int. Cl.

| | |
|---|---|
| ***H01H 9/34*** | (2006.01) |
| *H01H 9/44* | (2006.01) |
| *H01H 51/06* | (2006.01) |
| *H01H 50/54* | (2006.01) |

(56) References Cited

U.S. PATENT DOCUMENTS

| | | | | |
|---|---|---|---|---|
| 6,975,194 | B2 * | 12/2005 | Nishida et al. | 335/132 |
| 7,145,422 | B2 * | 12/2006 | Imanishi et al. | 335/201 |
| 7,157,995 | B2 * | 1/2007 | Nishida et al. | 335/126 |
| 7,286,031 | B2 * | 10/2007 | Nishida et al. | 335/132 |
| 7,852,178 | B2 * | 12/2010 | Bush et al. | 335/126 |
| 7,859,373 | B2 * | 12/2010 | Yamamoto et al. | 335/126 |
| 7,911,301 | B2 * | 3/2011 | Yano et al. | 335/131 |
| 7,948,338 | B2 * | 5/2011 | Niimi et al. | 335/126 |
| 8,138,440 | B2 * | 3/2012 | Onufriyenko et al. | 218/154 |
| 8,138,863 | B2 * | 3/2012 | Tanaka et al. | 335/195 |
| 8,138,872 | B2 * | 3/2012 | Yoshihara et al. | 335/281 |
| 8,179,217 | B2 * | 5/2012 | Kawaguchi et al. | 335/80 |
| 8,188,818 | B2 * | 5/2012 | Cho et al. | 335/126 |
| 8,222,980 | B2 * | 7/2012 | Yamagata et al. | 335/126 |
| 8,390,410 | B2 * | 3/2013 | Kojima et al. | 335/201 |
| 8,410,878 | B1 * | 4/2013 | Takaya et al. | 335/201 |
| 2004/0080389 | A1 * | 4/2004 | Nishida et al. | 335/132 |
| 2005/0146405 | A1 * | 7/2005 | Nishida et al. | 335/132 |
| 2005/0148216 | A1 | 7/2005 | Nishida et al. | |
| 2008/0122562 | A1 | 5/2008 | Bush et al. | |
| 2009/0039545 | A1 | 2/2009 | Hayase et al. | |
| 2009/0284335 | A1 * | 11/2009 | Kim et al. | 335/201 |
| 2009/0322455 | A1 * | 12/2009 | Yoshihara et al. | 335/189 |

FOREIGN PATENT DOCUMENTS

| | | | |
|---|---|---|---|
| JP | H03-103385 | A | 4/1991 |
| JP | H09-259728 | A | 10/1997 |
| JP | 2003-308773 | A | 10/2003 |
| JP | 2005-015773 | A | 1/2005 |
| JP | 2005-019160 | A | 1/2005 |
| JP | 2005-183277 | A | 7/2005 |
| JP | 2010-010059 | A | 1/2010 |
| JP | 2010-257788 | A | 11/2010 |

* cited by examiner

ELECTROMAGNETIC CONTACTOR

TECHNICAL FIELD

The present invention relates to an electromagnetic contactor wherein a contact mechanism including fixed contacts and a movable contact is housed in an arc extinguishing chamber.

BACKGROUND ART

As an electromagnetic contactor wherein a contact mechanism is housed in an arc extinguishing chamber, there is provided a sealed contact device having a sealed receptacle formed in a box-form with one surface opened from a heat resistant material such as a ceramic (for example, refer to Patent Document 1). The sealed contact device described in PTL 1 is such that fixed terminals are hermetically joined by brazing in through holes formed in two places in the bottom portion of the sealed receptacle. A movable contact provided with movable contact points contacting with and separating from the fixed contact points formed on the fixed terminals is disposed in the sealed receptacle. The sealed contact device has a configuration wherein an opened end portion of the sealed receptacle is connected to a first joint member formed in a rectangular form from a magnetic metal material, to which a bottomed cylindrical portion is hermetically joined, via a cylindrical second joint member formed from a metal material.

CITATION LIST

Patent Literature

PTL 1: Japanese Patent No. 3,107,288

SUMMARY OF INVENTION

Technical Problem

However, the heretofore known example described in Patent Document 1 is such that the sealed receptacle is formed in a box-form with one surface opened from a heat resistant material, such as a ceramic, to which the fixed terminals are brazed. It is necessary to perform a metalizing process on a surface of the bottom portion of the sealed receptacle in order to braze the fixed terminals but, as the receptacle is formed in a box-form, there is an unsolved problem in that it is necessary to screen print one sealed receptacle after another, resulting in a low productivity. Also, as a brazing jig used when assembling also corresponds to the three-dimensional structure of the sealed receptacle, there is also an unsolved problem in that a fabricating jig is of a complex form. Furthermore, there is an unsolved problem in that it is also difficult to control the flatness and warpage of the bottomed portion to which the fixed terminals of the sealed receptacle is brazed.

Therefore, the invention, focusing on the unsolved problems of the heretofore known example, has an object of providing an electromagnetic contactor such that it is possible to improve productivity, and simplify a brazing jig, and furthermore, to control the flatness and warpage of a plate portion supporting fixed contacts.

Solution to Problem

In order to achieve the heretofore described object, an electromagnetic contactor according to one aspect of the invention is characterized by including an arc extinguishing chamber housing a contact mechanism having a pair of fixed contacts and a movable contact that contacts with the pair of fixed contacts.

The arc extinguishing chamber has a plate-shaped fixed contact support insulating substrate including through holes to fix at least the pair of fixed contacts and formed with metal foils on an outer peripheral edge of one surface by a metalizing process. The pair of fixed contacts and a metal cylindrical body are brazed and joined to the metal foils of the fixed contact support insulating substrate. An insulating cylindrical body is disposed on the inner peripheral surface of the metal cylindrical body.

According to this configuration, as the arc extinguishing chamber is configured of the plate-like fixed contact support insulating substrate to which the fixed contacts are brazed, the metal cylindrical body brazed to the outer peripheral edge of one surface of the fixed contact support insulating substrate, and the insulating cylindrical body disposed on the inner side of the metal cylindrical body, it is possible, when performing a metalizing process for brazing the fixed contact support insulating substrate, to carry out a screen printing process in a condition in which a plurality of fixed contact support insulating substrates is vertically and horizontally arranged in close contact on a flat surface, and thus possible to improve productivity. Also, as the fixed contact support insulating substrate is plate-like, it is possible to simplify the assembly and brazing jigs, and thus possible to adopt an inexpensive configuration. Furthermore, it is also possible to easily carry out the control and management of flatness and warpage. Furthermore, it is possible to simultaneously carry out processes of brazing the fixed contacts and metal cylindrical body to the fixed contact support insulating substrate.

Also, an electromagnetic contactor according to another aspect of the invention is characterized in that the fixed contact support insulating substrate is formed of a ceramic insulating substrate.

According to this configuration, as the fixed contact support insulating substrate is configured of a ceramic insulating substrate, mass production is possible, thus enabling a reduction in fabrication cost.

Also, an electromagnetic contactor according to another aspect of the invention is characterized in that the insulating cylindrical body is configured by combining ceramic plates.

According to this configuration, as the insulating cylindrical body is configured of ceramic plates, the fabrication is easy.

Advantageous Effects of Invention

According to the invention, as the fixed contact support insulating substrate is formed plate-like, when performing a metalizing process for brazing, it is possible to carry out a screen printing in a condition in which a plurality of fixed contact support insulating substrates is vertically and horizontally arranged in close contact on a flat plate, and thus productivity dramatically improve. Also, as the fixed contact support insulating substrate is plate-like, it is possible to simplify jigs for fabrication and brazing. Furthermore, it is possible to easily carry out the control and management of the flatness and warpage of the fixed contact support insulating substrate. It is possible to simultaneously carry out brazings of the fixed contacts and metal cylindrical body to the fixed contact support insulating substrate, and thus possible to reduce fabrication cost.

DESCRIPTION OF EMBODIMENTS

Hereafter, a description will be given, based on the drawings, of an embodiment of the invention.

Figure 1:
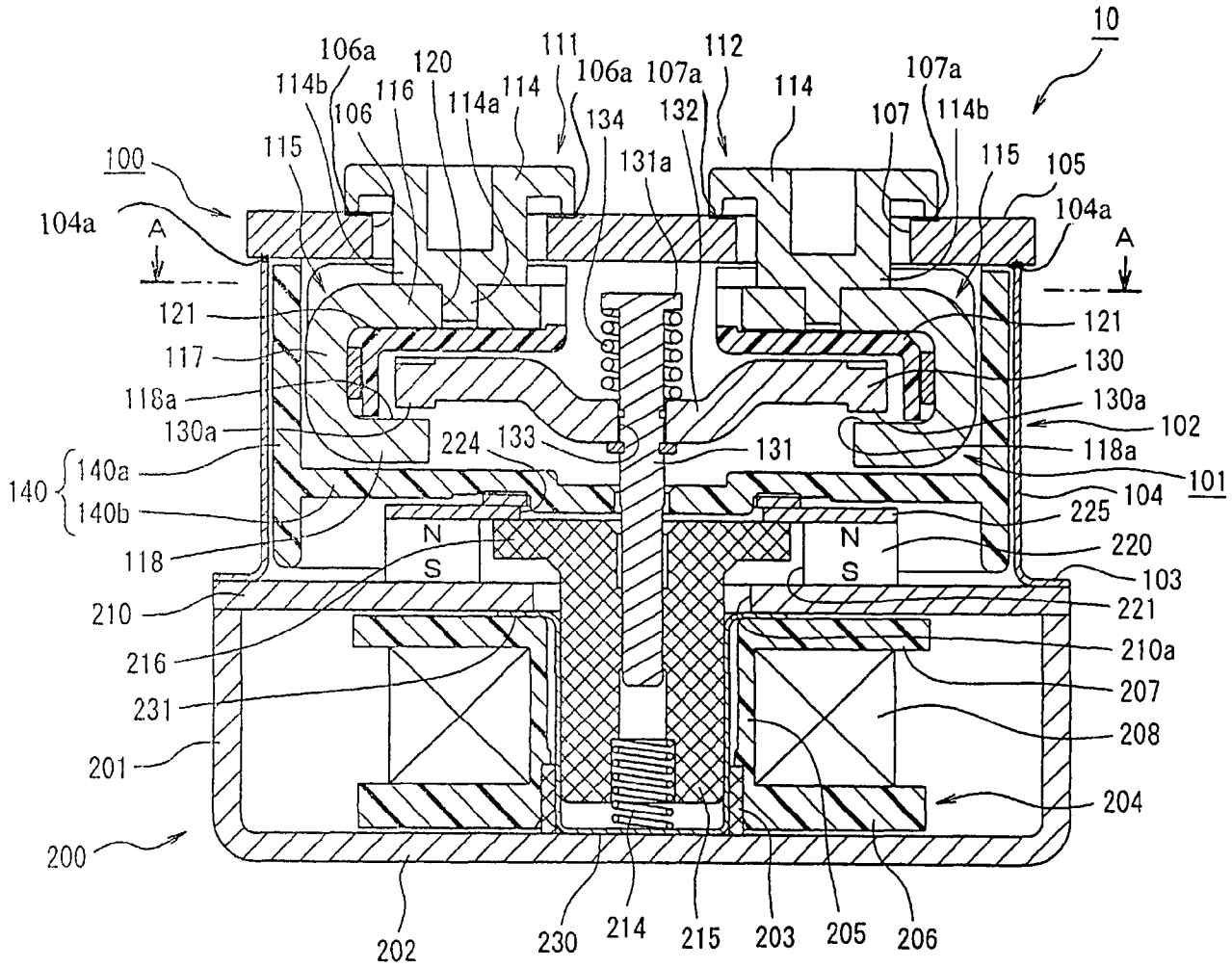
FIG. 1 is a sectional view showing a first embodiment of an electromagnetic contactor according to the invention.
Figure 2:
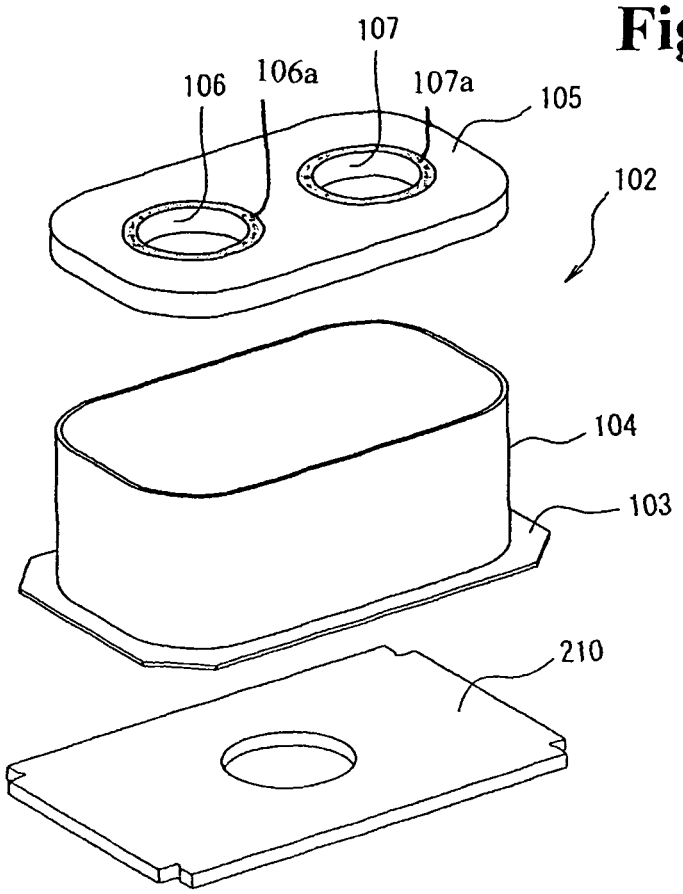
FIG. 2 an exploded perspective view showing an arc extinguishing chamber of FIG. 1.

FIG. 1 is a sectional view showing one example of an electromagnetic switch according to the invention, while FIG. 2 is an exploded perspective view of an arc extinguishing chamber. In FIGS. 1 and 2, numeral 10 is an electromagnetic contactor, and the electromagnetic contactor 10 is configured of a contact device 100 in which a contact mechanism is disposed, and an electromagnet unit 200 that drives the contact device 100.

The contact device 100 has an arc extinguishing chamber 102 in which a contact mechanism 101 is housed, as is clear from FIGS. 1 and 2. The arc extinguishing chamber 102, as shown in FIG. 2, includes a metal rectangular cylindrical body 104 having a metal flange portion 103 protruding outward from a lower end portion, and a fixed contact support insulating substrate 105 having a plate-like ceramic insulating substrate that closes off the upper end of the metal rectangular cylindrical body 104.

The metal rectangular cylindrical body 104 is such that the flange portion 103 thereof is sealingly joined and fixed to an upper magnetic yoke 210 of the electromagnet unit 200, to be described hereafter.

Also, through holes 106 and 107 in which a pair of fixed contacts 111 and 112 to be described hereafter is inserted, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts with the metal rectangular cylindrical body 104. To carry out the metalizing process, in a condition in which a plurality of fixed contact support insulating substrates 105 is arranged vertically and horizontally on a flat surface, metal foils 106*a* and 107*a* (for example, a copper foil) are formed around the through holes 106 and 107 and metal foils 104*a* is formed at a position that contacts with the metal rectangular cylindrical body 104.

The contact mechanism 101, as shown in FIG. 1, includes the pair of fixed contacts 111 and 112 inserted into and fixed in the through holes 106 and 107 of the fixed contact support insulating substrate 105 of the arc extinguishing chamber 102. Each of the fixed contacts 111 and 112 includes a support conductor portion 114, having a flange portion protruding outward on an upper end thereof, inserted into the through holes 106 and 107 of the fixed contact support insulating substrate 105, and a C-shaped portion 115 having the inner side opened, linked to the support conductor portion 114 and disposed on the lower surface side of the fixed contact support insulating substrate 105.

The C-shaped portion 115 is formed in a C-shape of an upper plate portion 116 extending to the outer side along the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, toward the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* formed protruding from the lower surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Further, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115, as shown in FIGS. 3(*a*) and 3(*b*).

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and fitting portions 125, each formed on the inward side from the upper end of each of the side plate portions 123 and 124, that fit onto a small diameter portion 114*b* formed on the support conductor portion 114 of each of the fixed contacts 111 and 112.

Figure 3A:
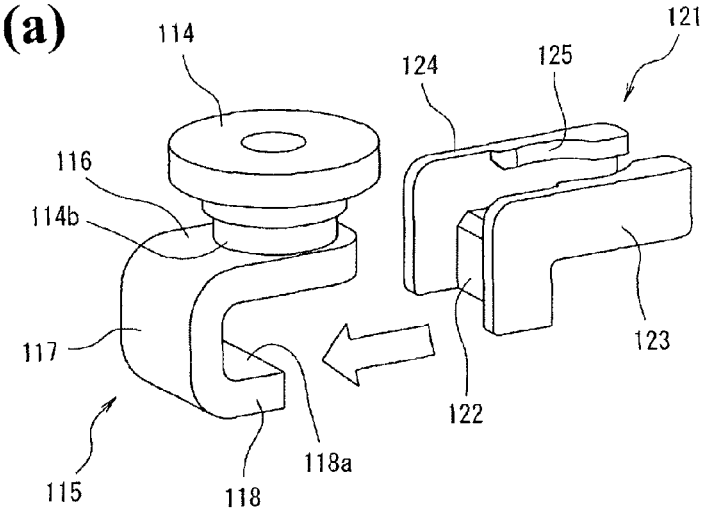
FIGS. 3(*a*)-3(*c*) are diagrams showing an insulating cover of a contact mechanism, wherein FIG. 3(*a*) is a perspective view, FIG. 3(*b*) is a plan view before mounting, and FIG. 3(*c*) is a plan view after mounting.
Figure 3B:
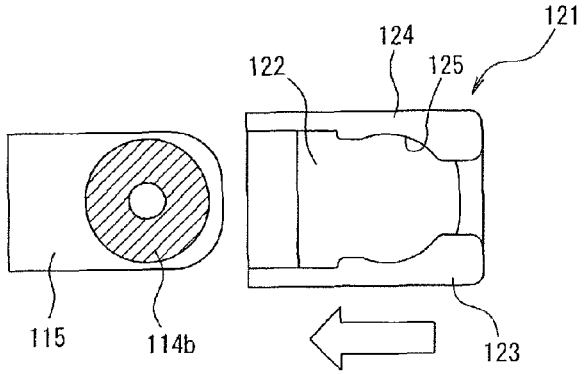
Figure 3C:
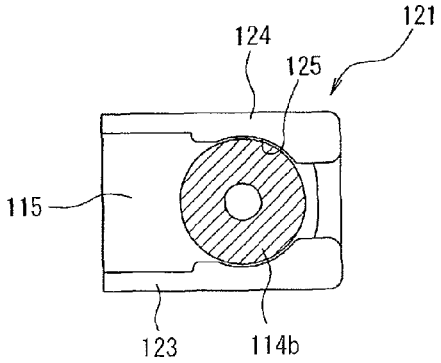

Consequently, the insulating cover 121 is placed in a condition in which the fitting portions 125 are facing the small diameter portion 114*b* of the support conductor portion 114 of each of the fixed contacts 111 and 112, as shown in FIGS. 3(*a*) and 3(*b*), after which, as shown in FIG. 3(*c*), the fitting portions 125 are fitted onto the small diameter portion 114*b* of the support conductor portion 114 by pushing the insulating cover 121.

Figure 4A:
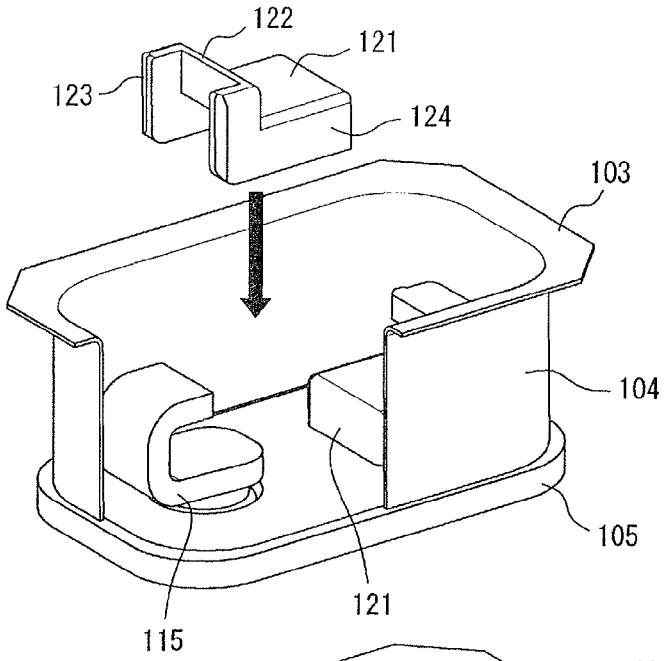
FIG. 4 is a perspective view showing an insulating cover mounting method.
Figure 4B:
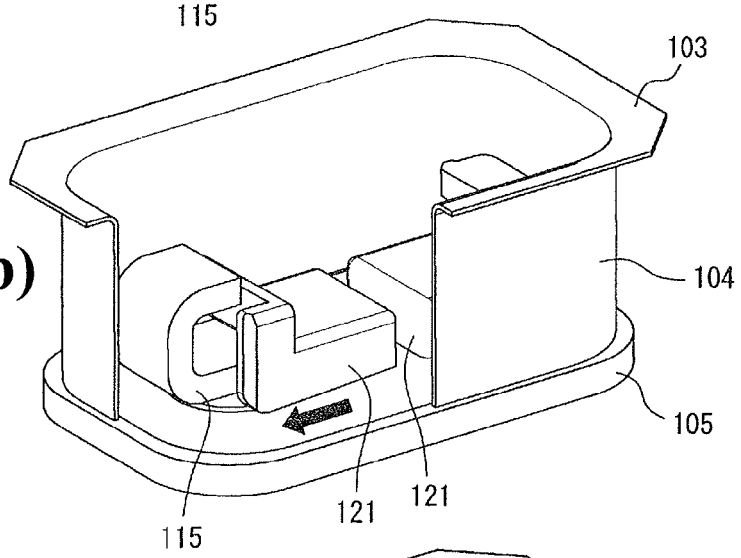
Figure 4C:
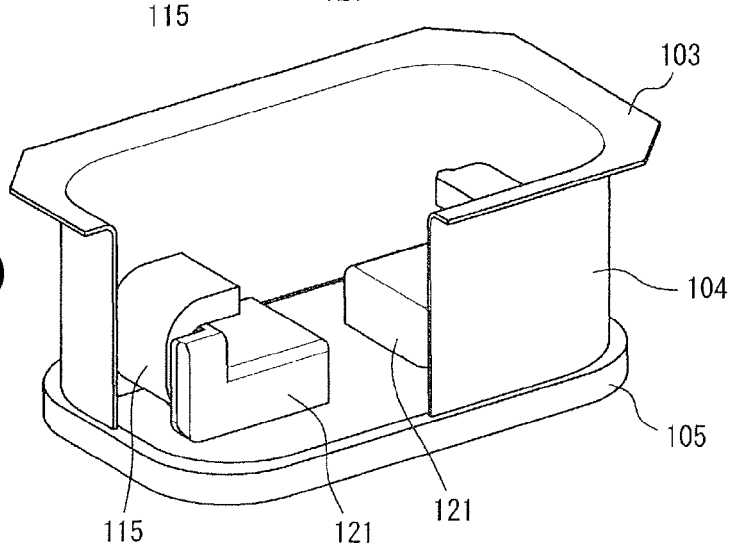

Actually, with the arc extinguishing chamber 102 after the fixed contacts 111 and 112 have been attached in a condition wherein the fixed contact support insulating substrate 105 is on the lower side, the insulating cover 121 is inserted from an upper aperture portion between the fixed contacts 111 and 112 in a vertically reversed condition of that in FIGS. 3(*a*) to 3(*c*), as shown in FIG. 4(*a*).

Next, in a condition in which the fitting portions 125 are in contact with the fixed contact support insulating substrate 105, as shown in FIG. 4(*b*), the fitting portions 125 are fitted onto and fixed to the small diameter portion 114*b* of the support conductor portion 114 of each of the fixed contacts 111 and 112 by pushing the insulating cover 121 to the outer side, as shown in FIG. 4(*c*).

By mounting the insulating cover 121 on the C-shaped portion 115 of each of the fixed contacts 111 and 112 in this way, only the upper surface side of the lower plate portion 118 of the inner peripheral surface of the C-shaped portion 115 is exposed, thus forming a contact portion 118*a*.

Figure 5:
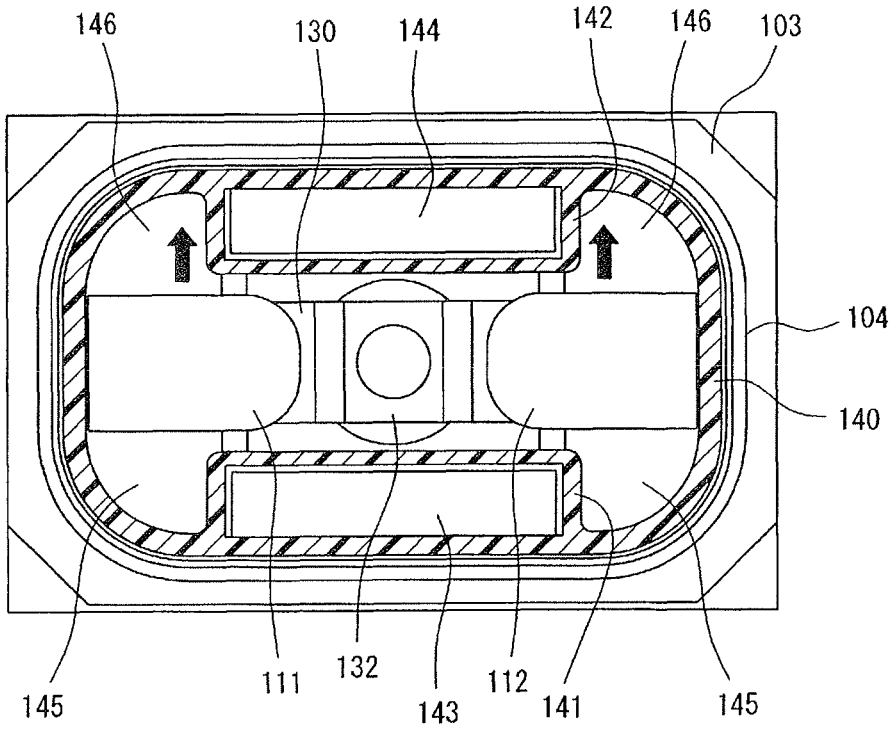
FIG. 5 is a sectional view along line A-A in FIG. 1.

Further, the movable contact 130 is disposed in such a way that both end portions are disposed in the C-shaped portions 115 of the fixed contacts 111 and 112. The movable contact 130 is supported by a connecting shaft 131 fixed in a movable plunger 215 of the electromagnet unit 200, to be described hereafter. The movable contact 130 is such that, as shown in FIGS. 1 and 5, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side thereof into a contact spring 134, then inserted into the through hole 133 of the movable contact 130, bringing the upper end of the contact spring 134 into contact with the flange portion 131*a*, and the movable contact 130 is positioned using, for example, a C-ring 135 so as to obtain a predetermined urging force from the contact spring 134.

The movable contact 130, in a released condition, takes on a condition wherein contact portions 130*a* at either end and the contact portions 118*a* of the lower plate portions 118 of the C-shaped portions 115 of the fixed contacts 111 and 112 are separated from each other and maintaining a predetermined interval. Also, the movable contact 130 is set so that, in a closed position, the contact portions at either end contact with the contact portions 118*a* of the lower plate portions 118 of the C-shaped portions 115 of the fixed contacts 111 and 112 at a predetermined contact pressure due to the contact spring 134.

Figure 9A:
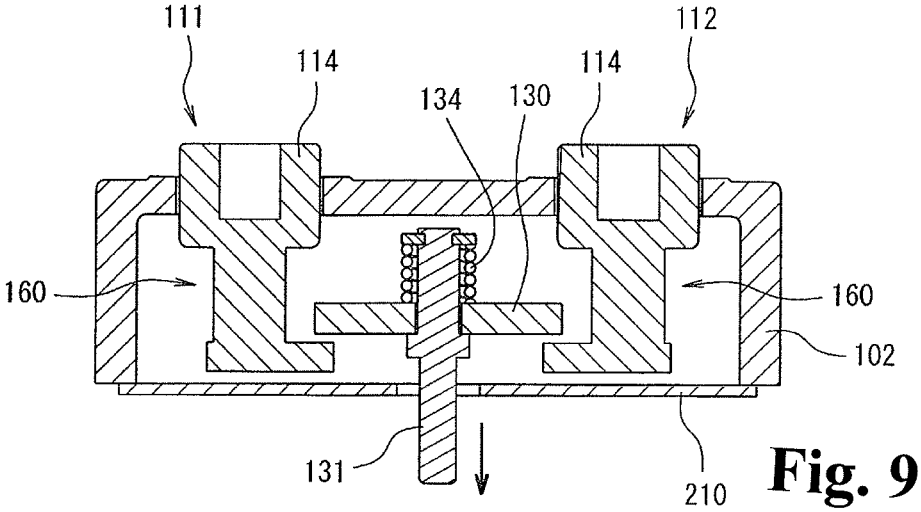
FIGS. 9(*a*)-9(*b*) are diagrams showing another example of the contact mechanism, wherein FIG. 9(*a*) is a sectional view, and FIG. 9(*b*) is a perspective view.
Figure 9B:
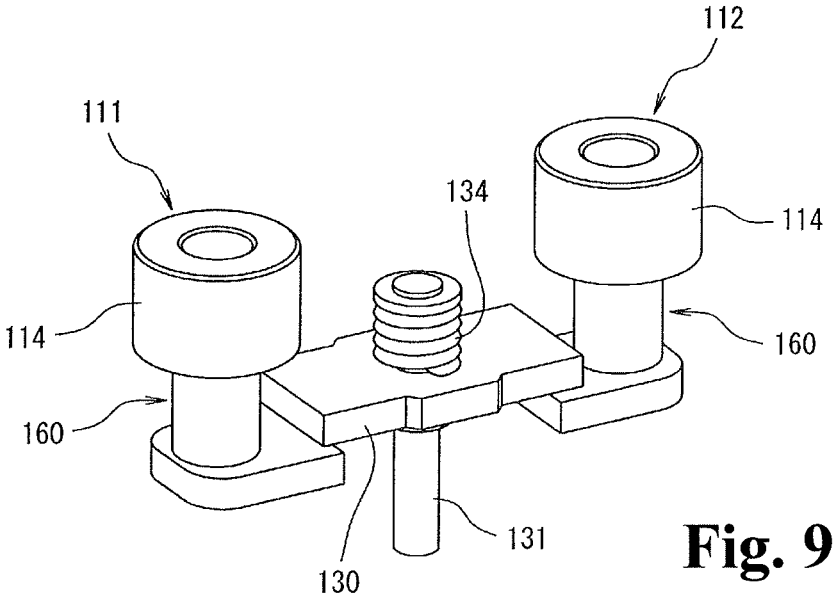

Furthermore, an insulating cylindrical body 140 formed in a bottomed rectangular cylindrical form by a rectangular cylindrical portion 140*a* and a bottom plate portion 140*b* formed on the lower surface side of the rectangular cylindrical portion 140*a* is disposed on the inner peripheral surface of the metal rectangular cylindrical body 104 of the arc extinguishing chamber 102, as shown in FIGS. 9(*a*)-9(*b*). The insulating cylindrical body 140, made of, for example, a synthetic resin, is such that the rectangular cylindrical portion 140*a* and bottom plate portion 140*b* are integrally formed. Further, magnet housing cylindrical bodies 141 and 142 acting as magnet housing portions are formed integrally in positions on the insulating cylindrical body 140 facing the side surfaces of the movable contact 130. Arc extinguishing permanent magnets 143 and 144 are inserted into and fixed in the magnet housing cylindrical bodies 141 and 142 respectively.

The arc extinguishing permanent magnets 143 and 144 are magnetized in a thickness direction so that mutually opposing faces thereof are homopolar, for example, N-poles. Also, the arc extinguishing permanent magnets 143 and 144 are set so that both end portions in a left-right direction are slightly inward of positions in which the contact portions 118*a* of the fixed contacts 111 and 112 and the contact portions of the movable contact 130 are opposed, as shown in FIG. 5. Further, arc extinguishing spaces 145 and 146 are formed on the outer sides in a left-right direction of the magnet housing cylindrical bodies 141 and 142 respectively, that is, in a longitudinal direction of the movable contact.

Also, movable contact guide members 148 and 149, which regulate the turning of the movable contact 130, are formed protruding, sliding against side edges of the magnet housing cylindrical bodies 141 and 142 toward either end of the movable contact 130.

Consequently, the insulating cylindrical body 140 includes the function of positioning the arc extinguishing permanent magnets 143 and 144 with the magnet housing cylindrical bodies 141 and 142, the function of protecting the arc extinguishing permanent magnets 143 and 144 from an arc, and an insulating function that blocks the effect of the arc on the metal rectangular cylindrical body 104 improving the rigidity of the external portion.

Further, by disposing the arc extinguishing permanent magnets 143 and 144 on the inner peripheral surface side of the insulating cylindrical body 140, it is possible to bring the arc extinguishing permanent magnets 143 and 144 near to the movable contact 130. Because of this, as shown in FIG. 6(*a*), magnetic flux $\phi$ emanating from the N-pole sides of the two arc extinguishing permanent magnets 143 and 144 crosses portions in which the contact portions 118*a* of the fixed contacts 111 and 112 and the contact portions 130*a* of the movable contact 130 are opposed in a left-right direction, from the inner side to the outer side, with a large flux density.

Figure 6A:
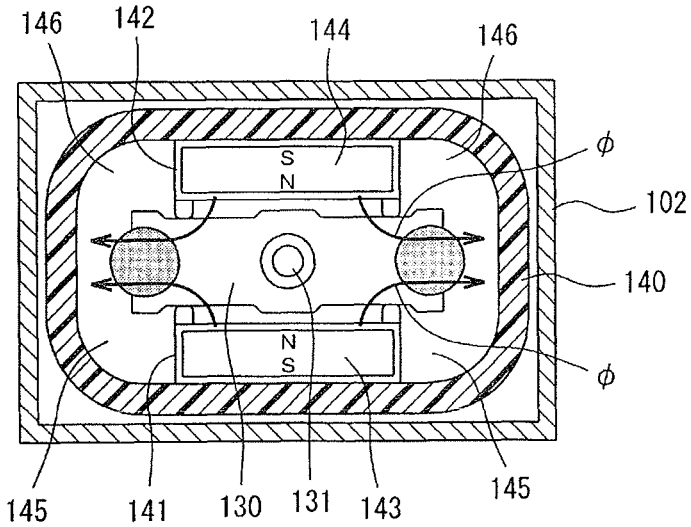
FIG. 6 is an illustration accompanying a description of arc extinguishing by an arc extinguishing permanent magnet according to the invention.
Figure 6B:
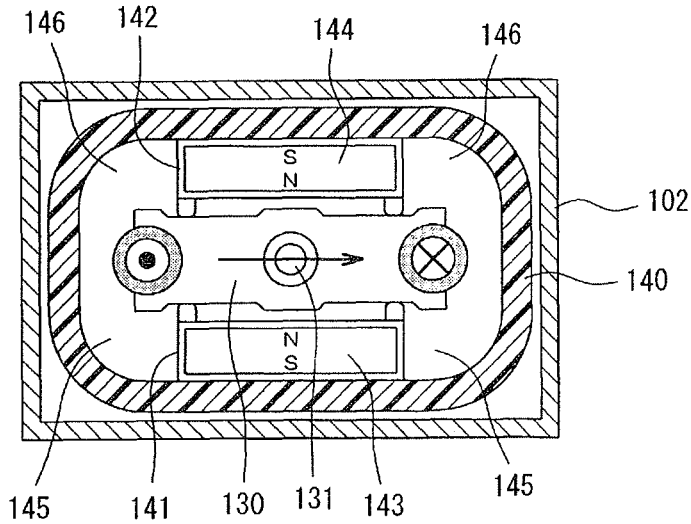
Figure 6C:
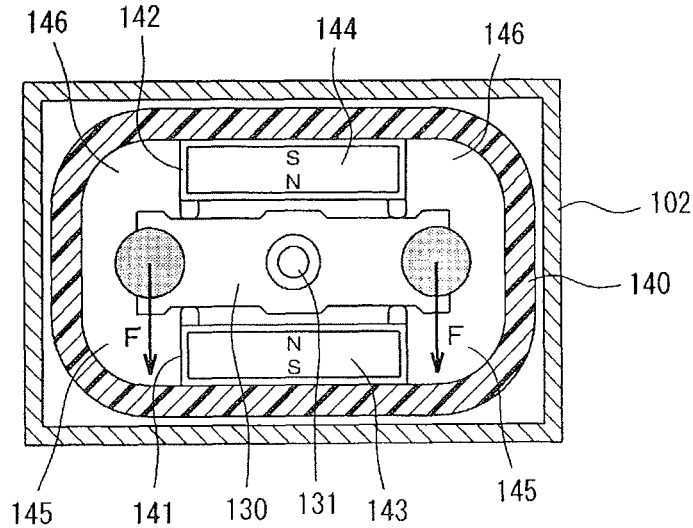

Consequently, assuming that the fixed contact 111 is connected to a current supply source and the fixed contact 112 is connected to a load side, the current direction in the closed condition is such that the current flows from the fixed contact 111 through the movable contact 130 to the fixed contact 112, as shown in FIG. 6(*b*). Then, when changing from the closed condition to the released condition by causing the movable contact 130 to move away upward from the fixed contacts 111 and 112, an arc is generated between the contact portions 118*a* of the fixed contacts 111 and 112 and the contact portions 130*a* of the movable contact 130.

The arc is extended to the arc extinguishing space 145 side on the arc extinguishing permanent magnet 143 side by the magnetic flux $\phi$ from the arc extinguishing permanent magnets 143 and 144, as shown in FIG. 6(*c*). At this time, as the arc extinguishing spaces 145 and 146 are formed as widely as the thickness of the arc extinguishing permanent magnets 143 and 144, it is possible to obtain a long arc length, and thus possible to reliably extinguish the arc.

Figure 7A:
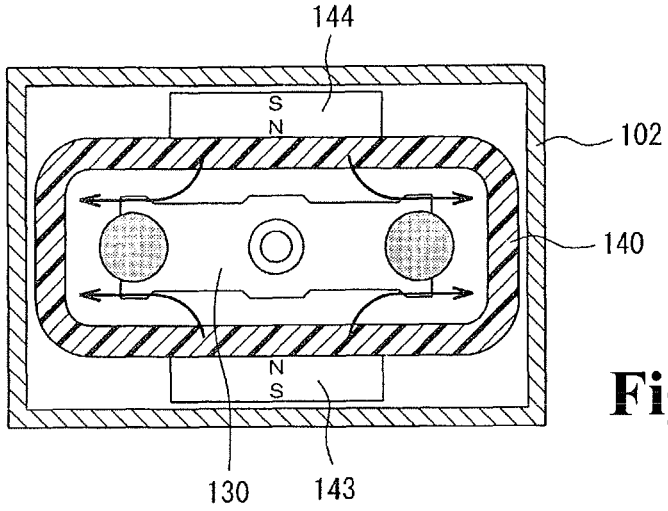
FIG. 7 is an illustration accompanying a description of arc extinguishing when the arc extinguishing permanent magnet is disposed on the outer side of an insulating case.
Figure 7B:
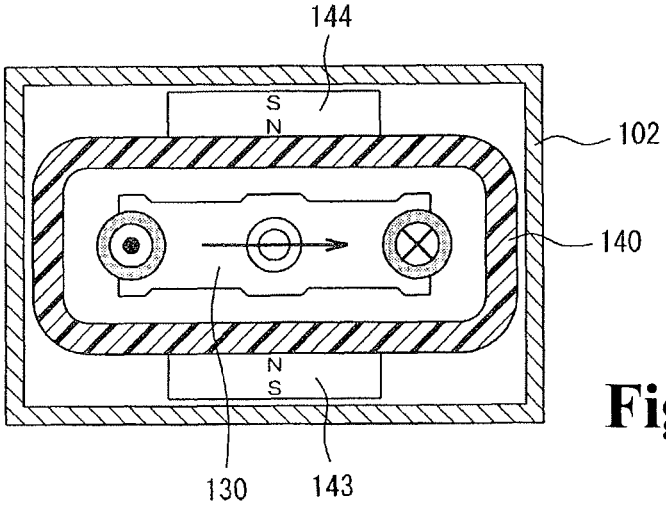
Figure 7C:
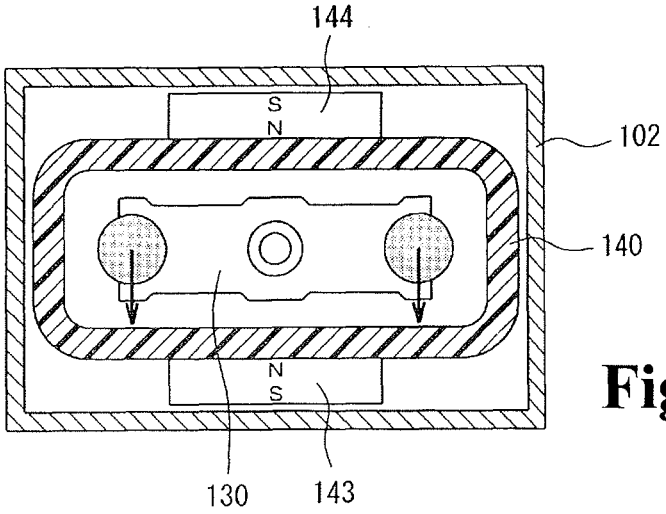

Incidentally, when the arc extinguishing permanent magnets 143 and 144 are disposed on the outer side of the insulating cylindrical body 140, as shown in FIGS. 7(*a*) to 7(*c*), there is an increase in the distance to the positions in which the contact portions 118*a* of the fixed contacts 111 and 112 and the contact portions 130*a* of the movable contact 130 are facing each other, and when the same permanent magnets as in this embodiment are applied, the density of the magnetic flux crossing the arc decreases.

Because of this, the Lorentz force acting on an arc generated when shifting from the closed condition to the released condition decreases, and it is no longer possible to sufficiently extend the arc. In order to improve the arc extinguishing performance, it is necessary to increase the magnetization of the arc extinguishing permanent magnets 143 and 144. Moreover, in order to shorten the distance between the arc extinguishing permanent magnets 143 and 144 and the contact portions of the fixed contacts 111 and 112 and movable contact 130, it is necessary to reduce the depth in a front-back direction of the insulating cylindrical body 140, and there is a problem in that it is not possible to secure sufficient arc extinguishing space to extinguish the arc.

However, according to the heretofore described embodiment, the arc extinguishing permanent magnets 143 and 144 are disposed on the inner side of the insulating cylindrical body 140, meaning that the problems occurring when the arc extinguishing permanent magnets 143 and 144 are disposed on the outer side of the insulating cylindrical body 140 can all be solved.

The electromagnet unit 200, as shown in FIG. 1, has a magnetic yoke 201 of a flattened U-shape when seen from the side, and a cylindrical auxiliary yoke 203 is fixed to a central portion of a bottom plate portion 202 of the magnetic yoke 201. A spool 204 is disposed on the outer side of the cylindrical auxiliary yoke 203.

The spool 204 is configured of a central circular cylindrical portion 205 in which the cylindrical auxiliary yoke 203 is inserted, a lower flange portion 206 protruding outward in a radial direction from a lower end portion of the central circular cylindrical portion 205, and an upper flange portion 207 protruding outward in a radial direction from slightly below the upper end of the central circular cylindrical portion 205. Further, an exciting coil 208 is mounted wound in a housing space configured of the central circular cylindrical portion 205, lower flange portion 206, and upper flange portion 207.

Further, an upper magnetic yoke 210 is fixed between upper ends forming an opened end of the magnetic yoke 201. A through hole 210*a* facing the central circular cylindrical portion 205 of the spool 204 is formed in a central portion of the upper magnetic yoke 210.

Further, the movable plunger 215, in which a return spring 214 is disposed between a bottom portion and the bottom plate portion 202 of the magnetic yoke 201, is disposed in the central circular cylindrical portion 205 of the spool 204 so as to be slidable up and down. A peripheral flange portion 216 protruding outward in a radial direction is formed on an upper end portion of the movable plunger 215 protruding upward from the upper magnetic yoke 210.

Also, a permanent magnet 220 formed in a ring-form by having, for example, a quadrate external form and a circular central aperture 221 is fixed to the upper surface of the upper magnetic yoke 210 so as to enclose the peripheral flange portion 216 of the movable plunger 215. The permanent magnet 220 is magnetized in an up-down direction, that is, a thickness direction, so that, for example, the upper end side is an N-pole while the lower end side is an S-pole. Taking the form of the central aperture 221 of the permanent magnet 220 to be a form tailored to the form of the peripheral flange portion 216, the form of the outer peripheral surface can be any form, such as a circle or a quadrate.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 contacts with the lower surface of the auxiliary yoke 225.

Also, the connecting shaft 131 that supports the movable contact 130 is screwed to the upper end surface of the movable plunger 215.

Further, the movable plunger 215 is covered with a cap 230 formed in a bottomed cylindrical form made of a non-magnetic body, and a flange portion 231 formed extending outward in a radial direction on an opened end of the cap 230 is sealingly joined to the lower surface of the upper magnetic yoke 210. By doing so, a hermetic receptacle, wherein the arc extinguishing chamber 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the arc extinguishing chamber 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this condition, it is assumed that the exciting coil 208 in the electromagnet unit 200 is in a non-excited state, and there exists a released condition wherein no exciting force causing the movable plunger 215 to descend is being generated in the electromagnet unit 200. In this released condition, the movable plunger 215 is urged in an upward direction away from the upper magnetic yoke 210 by the return spring 214. Simultaneously with this, an attracting force caused by the permanent magnet 220 acts on the auxiliary yoke 225, and the peripheral flange portion 216 of the movable plunger 215 is attracted. Because of this, the upper surface of the peripheral flange portion 216 of the movable plunger 215 contacts with the lower surface of the auxiliary yoke 225.

Because of this, the contact portions 130*a* of the contact mechanism 101 movable contact 130 connected to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted condition, and the contact mechanism 101 is in a condition wherein the contacts are opened.

In this way, as the urging force of the return spring 214 and the attracting force of the ring-form permanent magnet 220 both act on the movable plunger 215 in the released condition, there is no unplanned downward movement of the movable plunger 215 due to external vibration, shock, or the like, and it is thus possible to reliably prevent malfunction.

On the exciting coil 208 of the electromagnet unit 200 being excited in the released condition, an exciting force is generated in the electromagnet unit 200, and the movable plunger 215 is pressed downward against the urging force of the return spring 214 and the attracting force of the ring-form permanent magnet 220.

The descent of the movable plunger 215 is stopped by the lower surface of the peripheral flange portion 216 contacting with the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 come into contact with the contact portions 118*a* of the fixed contacts 111 and 112 with the contact pressure of the contact spring 134.

Because of this, there exists a closed contact condition wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction such as to cause the contacts of the movable contact 130 to open.

However, as the fixed contacts 111 and 112 are such that each C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions.

Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, as a result of which it is also possible to reduce thrust generated in the exciting coil 208, and it is thus possible to reduce the size of the overall configuration of the electromagnetic contactor.

When interrupting the supply of current to the load in the closed contact condition of the contact mechanism 101, the exciting of the exciting coil 208 of the electromagnet unit 200 is stopped.

By so doing, the exciting force causing the movable plunger 215 to move downward in the electromagnet unit 200 stops, as a result of which the movable plunger 215 is raised by the urging force of the return spring 214, and the attracting force of the ring-form permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is in contact with the fixed contacts 111 and 112 for as long as contact pressure is applied by the contact spring 134. Subsequently, there starts an opened contact condition, wherein the movable contact 130 moves upward away from the fixed contacts 111 and 112 at the point at which the contact pressure of the contact spring 134 stops.

On the opened contact condition starting, an arc is generated between the contact portions 118*a* of the fixed contacts 111 and 112 and the contact portions 130*a* of the movable contact 130, and the condition in which current is conducted is continued due to the arc. At this time, as the insulating cover 121 is mounted for covering the upper plate portion 116 and intermediate plate portion 117 of the C-shaped portion 115 of each of the fixed contacts 111 and 112, it is possible to cause the arc to be generated only between the contact portions 118*a* of the fixed contacts 111 and 112 and the contact portions 130*a* of the movable contact 130. Because of this, it is possible to reliably prevent the arc from moving on the C-shaped portions 115 of the fixed contacts 111 and 112, thereby stabilizing the arc generation condition, and thus possible to improve arc extinguishing performance. Moreover, as both side surfaces of each of the fixed contacts 111 and 112 are also covered with the insulating cover 121, it is also possible to reliably prevent the leading end of the arc from short-circuiting.

Further, as it is possible for the insulating cover 121 to be mounted on each of the fixed contacts 111 and 112 simply by fitting the fitting portions 125 onto the small diameter portion 114*b* of each of the fixed contacts 111 and 112, it is possible to easily carry out the mounting on each of the fixed contacts 111 and 112.

At this time, as the opposing magnetic pole faces of the arc extinguishing permanent magnets 143 and 144 are N-poles, and the outer sides thereof are S-poles, magnetic flux emanating from the N-poles, seen in plan view as shown in FIG. 6(*a*), crosses an arc generation portion of a portion in which the contact portion 118*a* of the arc extinguishing permanent magnets 143 and 144 fixed contact 111 and the contact portion 130*a* of the movable contact 130 are opposed, from the inner side to the outer side in the longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing magnets 143 and 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through the inside of the arc extinguishing space 145, reaching the upper surface side of the movable contact 130, and is extinguished.

Also, at the lower side and upper side of the arc extinguishing space 145, magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and it is thus possible to obtain good interruption performance.

Meanwhile, the current flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through the inside of the arc extinguishing space 145, reaching the side surface side of the fixed contact 112, and is extinguished.

Also, at the lower side and upper side of the arc extinguishing space 145, as heretofore described, magnetic flux inclines to the lower side and upper side with respect to the orientation of the magnetic flux between the contact portion 118*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, in the closed condition of the electromagnetic contactor 10, when adopting a released condition in a condition wherein a regenerative current flows from the load side to the direct current power source side, the direction of current in FIG. 6(*b*) is reversed, meaning that the Lorentz force F acts on the arc extinguishing space 146 side, and excepting that the arc is extended to the arc extinguishing space 146 side, the same arc extinguishing function is fulfilled.

At this time, as the arc extinguishing permanent magnets 143 and 144 are disposed in the magnet housing cylindrical bodies 141 and 142 formed in the insulating cylindrical body 140, the arc does not directly contact with the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal arc extinguishing chamber 102 with the insulating cylindrical body 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, the function of protecting the arc extinguishing permanent magnets 143 and 144 from the arc, and an insulating function that prevents the arc reaching the external metal rectangular cylindrical body 104, with the one insulating cylindrical body 140, it is possible to reduce manufacturing cost.

Also, as it is possible to increase the distance between the side edges of the movable contact 130 and the inner peripheral surface of the insulating cylindrical body 140 by an amount equivalent to the thickness of the arc extinguishing permanent magnets 143 and 144, it is possible to provide the sufficiently large arc extinguishing spaces 145 and 146, and thus possible to reliably carry out the extinguishing of the arc.

Furthermore, as the movable contact guide members 148 and 149 that slide against the side edges of the movable contact are formed protruding in positions on the permanent magnet housing cylindrical bodies 141 and 142 housing the arc extinguishing permanent magnets 143 and 144 opposing the movable contact 130, it is possible to reliably prevent the turning of the movable contact 130.

Figure 8:
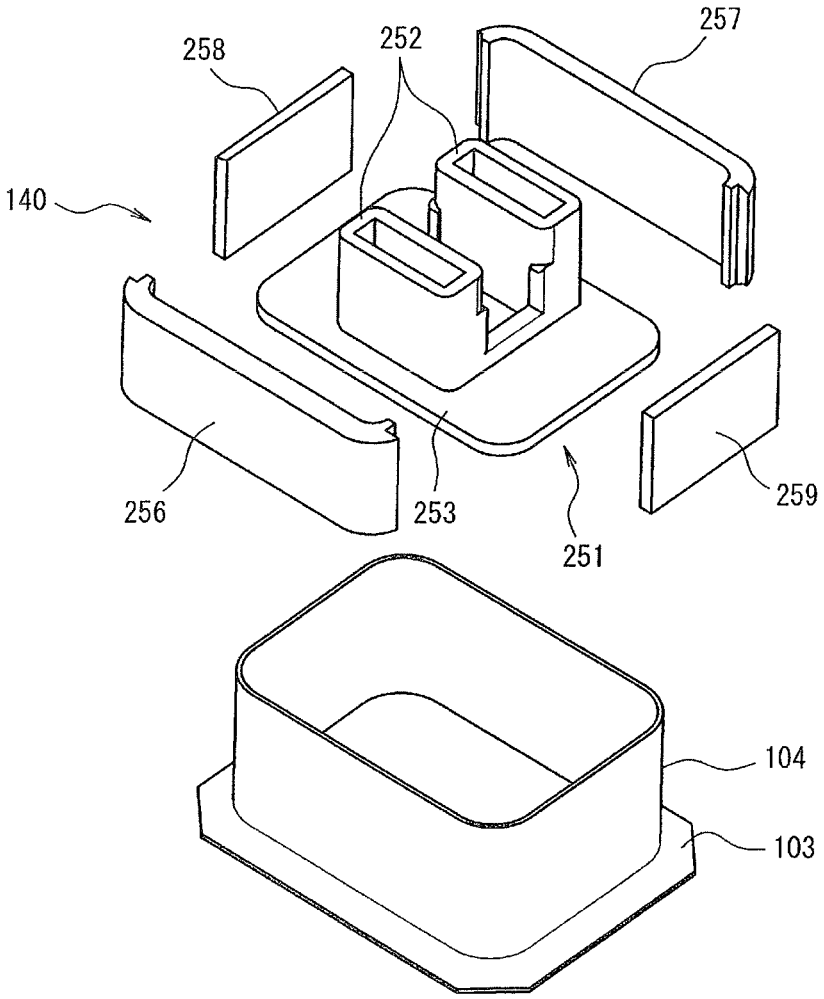
FIG. 8 is a perspective view showing another example of an insulating cylindrical body configuring the arc extinguishing chamber.

In the heretofore described embodiment, a description has been given of a case wherein the insulating cylindrical body 140 is configured by integrally forming the bottom plate portion 140*b* and rectangular cylindrical portion 140*a* but, this not being limiting, the insulating cylindrical body 140 may be formed by disposing an assembly of four side plate portions 256 to 259 configuring side walls on front and back and left and right end portions of a bottom plate portion 253 on which a magnet housing portion 252 of a base member 251 is formed, and connecting the side plate portions 256 to 259, as shown in FIG. 8. In this case, as the side wall portion is divided into the four side plate portions 256 to 259, manufacturing is easy compared with the case in which the whole is formed integrally. Furthermore, a rectangular cylindrical body wherein the four side plate portions 256 to 259 are integrated may also be formed.

Also, in the heretofore described embodiment, a description has been given of a case wherein the opposing magnetic pole faces of the arc extinguishing permanent magnets 143 and 144 are N-poles but, the invention is not being limited to this. Even when the opposing magnetic pole faces of the arc extinguishing permanent magnets 143 and 144 are S-poles, it is possible to obtain the same advantage as in the heretofore described embodiment, with the exception that the direction in which the magnetic flux crosses the arc and the direction of the Lorentz force are opposite.

In the heretofore described embodiment, a description has been given of a case wherein the C-shaped portion 115 is formed in each of the fixed contacts 111 and 112 but, the invention is not being limited to this. An L-shaped portion 160, of a form such that the upper plate portion 116 of the C-shaped portion 115 is omitted, may be connected to the support conductor portion 114, as shown in FIGS. 9(*a*) and 9(*b*).

In this case too, in the closed contact condition wherein the movable contact 130 contacts with the fixed contacts 111 and 112, it is possible to cause magnetic flux generated by the current flowing through a vertical plate portion of the L-shaped portion 160 to act on portions in which the fixed contacts 111 and 112 and the movable contact 130 are in contact. Because of this, it is possible to increase the magnetic flux density in the portions in which the fixed contacts 111 and 112 and the movable contact 130 are in contact, generating a Lorentz force that opposes the electromagnetic repulsion force.

Figure 10A:
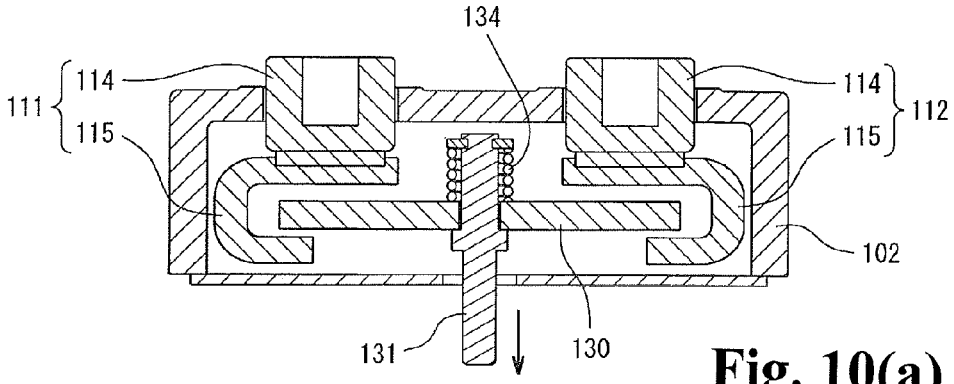
FIGS. 10(*a*)-10(*b*) are diagrams showing another example of a movable contact of the contact mechanism, wherein FIG. 10(*a*) is a sectional view, and FIG. 10(*b*) is a perspective view.
Figure 10B:
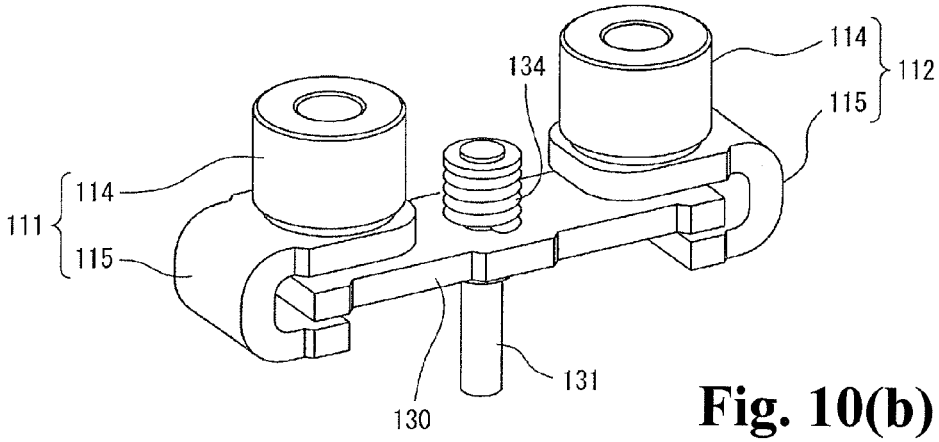

Also, in the heretofore described embodiment, description has been given of a case wherein the movable contact 130 has the depressed portion 132 in the central portion thereof but, the invention is not being limited to this, the depressed portion 132 may be omitted, forming a flat plate, as shown in FIGS. 10(*a*) and 10(*b*).

Also, in the heretofore described embodiment, a description has been given of a case wherein the connecting shaft 131 is screwed to the movable plunger 215, but the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but the invention is not limited to this. That is, a positioning large diameter portion may be formed protruding in a radial direction in the C-ring position of the connecting shaft 131, the contact spring 134 disposed after the movable contact 130 contacts with the large diameter portion, and the upper end of the contact spring 134 fixed with the C-ring.

Also, in the heretofore described embodiment, a description has been given of a case wherein a hermetic receptacle is configured of the arc extinguishing chamber 102 and cap 230, and gas is encapsulated inside the hermetic receptacle but, the invention is not limited to this, the gas encapsulation may be omitted when the interrupted current is small.

INDUSTRIAL APPLICABILITY

According to the invention, it is possible to provide an electromagnetic contactor such that it is possible to improve productivity, and simplify a brazing jig, and furthermore, it is possible to control the flatness and warpage of a plate portion supporting fixed contacts.

What is claimed is:

1. An electromagnetic contactor, comprising:

a contact mechanism having a pair of fixed contacts and a movable contact that contacts with the pair of fixed contacts, an arc extinguishing chamber housing the contact mechanism, and including a plate-shaped fixed contact support insulating substrate having through holes to fix the pair of fixed contacts, a metal cylindrical body fixed under the fixed contact support insulating substrate, and an insulating cylindrical body disposed inside the metal cylindrical body, metal foils formed around peripheral edges of the through holes on an outer surface of the fixed contact support insulating substrate, and another metal foil formed under the fixed contact support insulating substrate at a position where the metal cylindrical body contacts, the metal foils and the another metal foil being formed by a metalizing process, wherein the pair of fixed contacts and the metal cylindrical body are configured to be brazed and joined to the metal foils and the another metal foil of the fixed contact support insulating substrate, the fixed contact support insulating substrate is formed of a ceramic insulating substrate, and the metal foils and the another metal foil are fixed on the fixed contact support insulating substrate only at portions where the fixed contacts and the metal cylindrical body contact.

* * * * *